US005173053A

United States Patent [19]

Swanson et al.

[11] Patent Number: 5,173,053

[45] Date of Patent: Dec. 22, 1992

[54] ELECTRICAL CONNECTOR FOR AN ELECTROMECHANICAL DEVICE

[75] Inventors: Morris A. Swanson, Washington; Peter Hakkenberg, Dunlap, both of Ill.; Jeffrey R. Albers, Yucaipa, Calif.

[73] Assignee: Caterpillar Inc., Peoria, Ill.

[21] Appl. No.: 798,388

[22] Filed: Nov. 26, 1991

[51] Int. Cl.[5] ..... H01R 39/02

[52] U.S. Cl. ..... 439/27; 439/22

[58] Field of Search ..... 439/11-13, 439/18, 20-22, 27-29

[56] References Cited

U.S. PATENT DOCUMENTS

| | | | |
|---|---|---|---|
| 2,832,056 | 4/1958 | Stutzman | 439/20 X |
| 4,086,509 | 4/1978 | Manson | 310/232 |
| 4,395,085 | 7/1983 | Inoue | 339/94 |
| 4,470,301 | 9/1984 | Hutchins et al. | 73/304 R |
| 4,550,958 | 11/1985 | Smith | 339/5 R |
| 4,557,536 | 12/1985 | Geurts | 339/8 P |

*Primary Examiner*—Eugene F. Desmond
*Attorney, Agent, or Firm*—David M. Masterson

[57] ABSTRACT

An electrical connector for an electromechanical device is provided. The connector includes a housing having a first and second ends and an axis extending longitudinally through the housing. The housing is adapted to be connectable to a surface, and the electromechanical device is disposable in the housing. A rotatable portion having first and second ends is rotatably connected to the housing. The second end of the rotatable portion is positioned adjacent to the first end of the housing along the axis. A fastener fastens the rotatable portion to the housing, and the rotatable portion is adapted to turn about the axis. First and second contacts are axially aligned with and radially disposed from the axis. One of the contacts are disposed on the second end of the rotatable portion and the other on the first end of the housing. The first contact is biased by the fastener into slidable electrical contact with the second contact.

8 Claims, 3 Drawing Sheets

ELECTRICAL CONNECTOR FOR AN ELECTROMECHANICAL DEVICE

DESCRIPTION

1. Technical Field

This invention relates generally to an electrical connector and, more particularly, to an electrical connector for an electromechanical device.

2. Background Art

Electromechanical devices are used in a variety of applications as actuators, sensors, transducers, etc. In order for the electromechanical device to be operable, the device is connected to a power supply or other electrical circuitry. In many instances the electrical connection to the device is problematic, due to the environment in which the device is used.

Electromechanical devices usually are provided with a protective housing. Generally, a "female" receptacle is located on the housing. The female receptacle is adapted, for example, to carry electrical energy to the device. A "male" fitting is then plugged into the female receptacle, completing the electrical connection, which allows electrical energy to pass to and from the device.

In many applications the device is rotatably mounted to a surface. For example, the surface is machined to yield a bore defining a number of threads. The device is then screwed into the bore. However, when the mounting is complete the final rotational orientation of the device, and more specifically, the final angular orientation of the female receptacle cannot be predetermined and may be undesirable. Consequently, the connection of the electrical circuitry to the device can be cumbersome or, in some instances, impossible.

Further, the area in which the device is to be mounted may be limited in space, thus limiting connecting capabilities. For example, a device may be mounted in an engine compartment in which over-head room is scarce. Moreover, a cover may be placed over the device further limiting the available space. Consequently, the physical dimensions of the device, including the female receptacle, creates spatial limitations making the connection increasingly difficult.

Finally, when the device is used in a harsh environment the connection may be broken. For example, mounting the device on engine heads exposes connections and accompanying wiring harnesses to high temperatures, powerful resonant vibrations and, at times, corrosive agents such as diesel fuel and engine cleaners. Many times the connection may not hold due to the external vibrations or the connection may become shorted due to the corrosive agents causing a deteriorating effect.

The present invention is directed to overcoming one or more of the problems as set forth above.

DISCLOSURE OF THE INVENTION

In one aspect of the present invention, an electrical connector for an electromechanical device is provided. The connector includes a housing having first and second ends and an axis extending longitudinally through the housing. The housing is adapted to be connectable to a surface, and the electromechanical device is disposable in the housing. A rotatable portion having first and second ends is rotatably connected to the housing. The second end of the rotatable portion is positioned adjacent to the first end of the housing along the axis. A fastener fastens the rotatable portion to the housing, and the rotatable portion is adapted to turn about the axis. First and second contacts are axially aligned with and radially disposed from the axis. One of the contacts are disposed on the second end of the rotatable portion and the other on the first end of the housing. The first contact is biased by the fastener into slidable electrical contact with the second contact.

BRIEF DESCRIPTION OF THE DRAWINGS

For a better understanding of the present invention, reference may be made to the accompanying drawings in which.

BEST MODE FOR CARRYING OUT THE INVENTION

Figure 1:
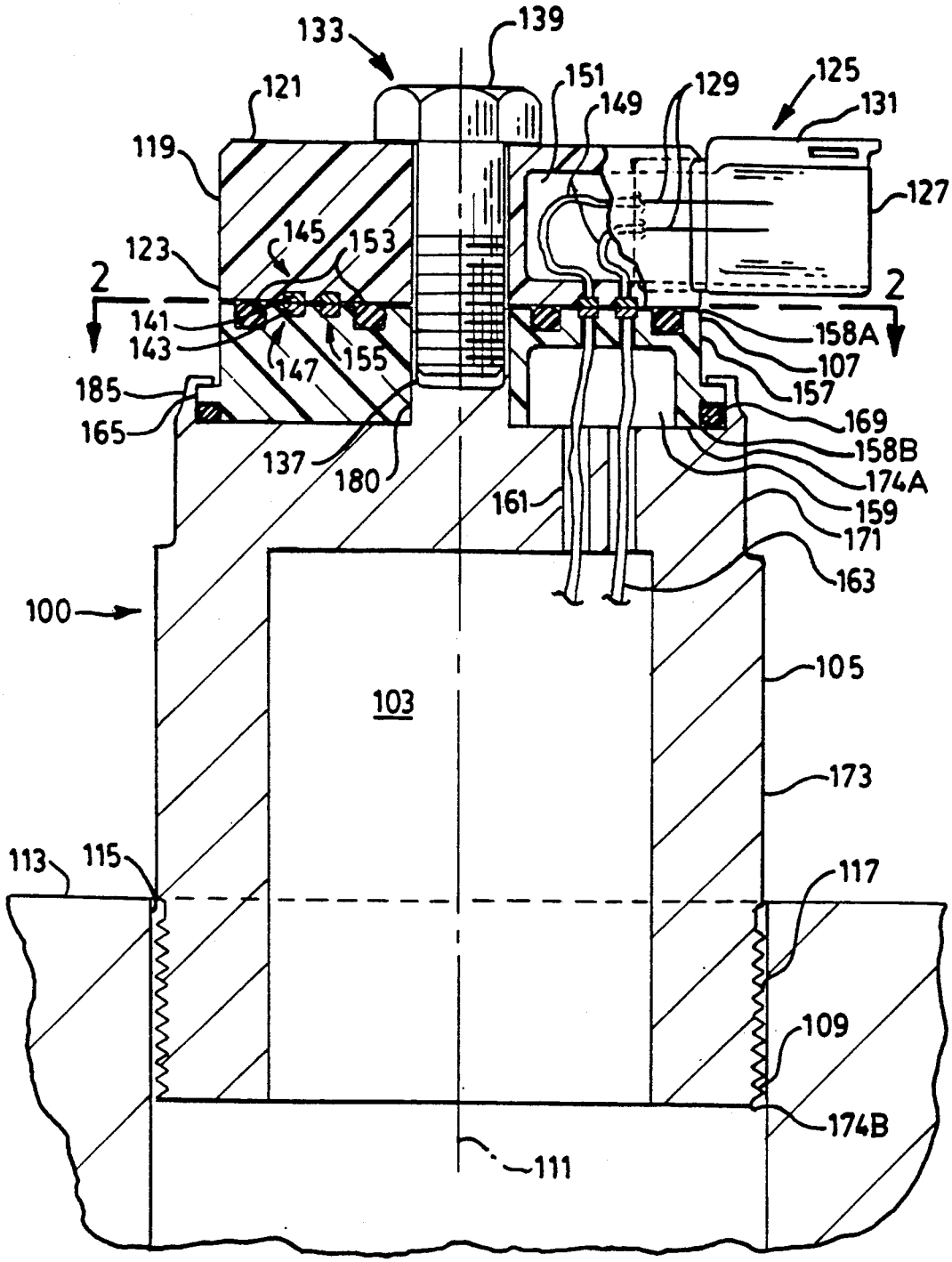
FIG. 1 is a cross sectional view illustrating one embodiment of the present invention.

Shown generally in FIG. 1 is one embodiment of an electrical connector 100 for an electromechanical device 103. The electromechanical device 103 may, for example, be an actuator, sensor, or transducer. The electrical connector 100 includes a housing 105 having first and second ends 107,109 and axis 111 extending longitudinally through the housing 105. The mechanical device 103 is disposable in the housing 105. The housing 105 is adapted to be connectable to a surface 113. For example, the surface 113 includes a threaded bore 115. Moreover, the housing 105 includes a threaded end portion 117 adjacent the second end 109 and is adapted to be screw threadably mountable in the surface bore 115. Further, the housing 105 may be a single piece assembly or an assembly of multiple pieces, for example. The number of pieces comprising the housing 105 is not critical to the present invention.

A rotatable portion 119 has first and second ends 121,123 and is rotatably connected to the housing 105. More particularly, the second end 123 of the rotatable portion 119 is positioned adjacent to the first end 107 of the housing 105 along the axis 111. A receptacle 125 is mounted on the rotatable portion 119. The receptacle 125 includes an opening 127 to accept a fitting (not shown) to provide an external electrical connection to pins 129. As shown, the opening is orientated such that the connection is transverse the axis 111. Section 131 is for rigidly securing the fitting to the receptacle 125. The receptacle 125 is, for example, similar to the "DT series" receptacles made by the Deutsch Company.

A means 133 fastens the rotatable portion 119 to the housing 105 allowing the rotatable portion 119 to turn about the axis 111. More specifically, the first end of the housing 105 has a threaded bore 137. The bore 137 is formed in the housing 105 and is disposed about the axis 111. The fastening means 133 includes a threaded fastener 139 adapted to be threadably engaged to the bore 137. Consequently, the rotatable portion 119 is adapted to turn at least 360° about the axis 111.

First and second contacts 141,143 are axially aligned with and radially disposed from the axis 111. The first contact 141 is one of a first set of radially spaced contacts 145 and the second contact 143 is one of a second set 147 of radially spaced contacts. The first set of contacts 145 are disposed on the second end of the rotatable portion 119 and the second set of contacts are disposed on the first end of the housing 105. The first set of contacts is biased by the fastening means 133 into slidable, electrical contact with the second set of contacts 147.

Figure 2:
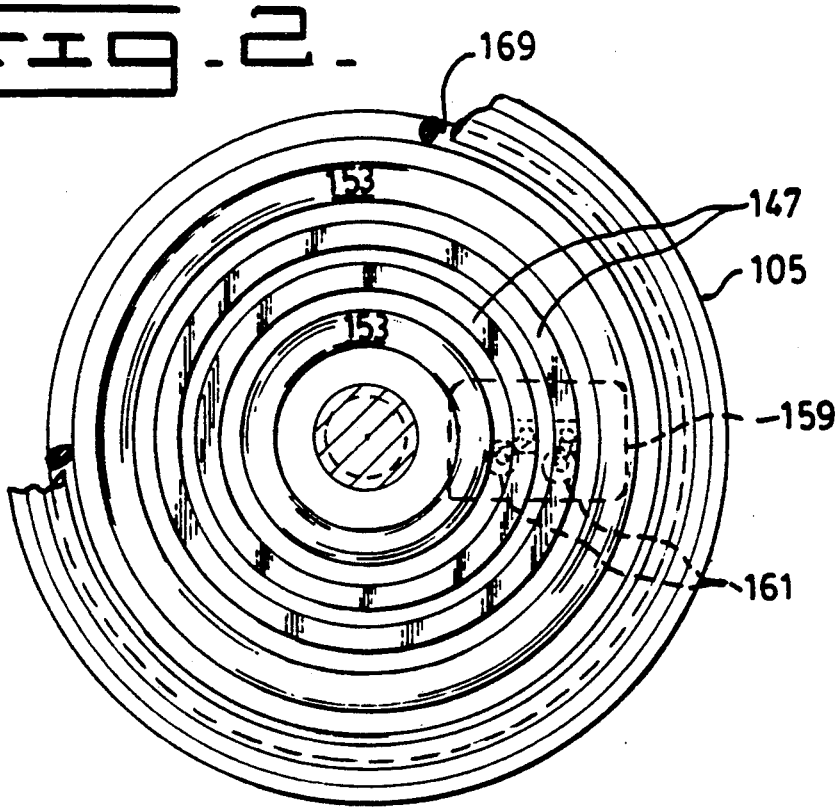
FIG. 2 is a top planar view taken along line 2—2 of FIG. 1 illustrating the one embodiment of the present invention.
Figure 4:
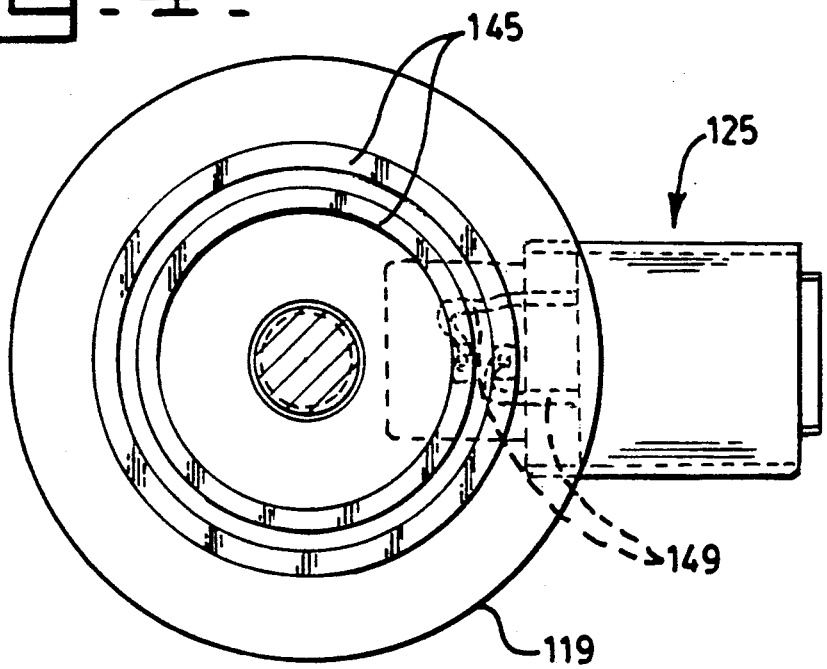
FIG. 4 is a bottom planar view taken along line 2—2 of FIG. 1 illustrating the one embodiment of the present invention.

As shown in FIG. 2, which is a top planar view of the housing 105, each contact of the second set 147 is in the form of an electrically conductive ring coaxially disposed about the axis 111. Similarly, as shown in FIG. 4, which is a bottom planar view of the rotatable portion 119, each contact of the first set 145 is in the form of an electrically conductive ring coaxially disposed about the axis 111. Each contact, for example, may be made of Copper or any other electrically conductive alloy as would become evident to those skilled in the art.

Referring back to FIG. 2, a pair of seals 153 are radially spaced from and coaxially disposed about the axis 111. As shown, the second set of contacts 147 are positioned between the seal pair 153. Advantageously, the seal pair 153 prevents contaminants from entering between the adjacent ends 123,107 thereby shielding the contacts. In the preferred embodiment, each one of the seal pair 153 is a circular band of elastomeric material, for example. Preferably, the band has a circular cross sectional area.

Adverting back to FIG. 1, the pins 129 are electrically connected to the first set of contacts 145 by wires 149. Advantageously, the rotatable portion 119 includes a cavity 151 which allows the contour of the wires 149 to assume many forms.

The housing 105 has a plurality of annular recesses 155, which are radially spaced from and coaxially disposed about the axis 111. As shown, the seal pair 153 and the second set of contacts 147 are disposed in the annular recesses 155.

Preferably, the housing 105 is a two piece assembly including a first portion 157 having first and second ends 158A,158B, and a second portion 173 having first and second ends 174A,174B. As shown, the first end 158A of the first portion 157 is positioned adjacent the second end 123 of the rotatable portion 119, and the first end 174A of the second portion 173 is positioned adjacent the second end 158A of the first portion 157.

The second portion 173 includes a cylindrical extension 180 which defines the bore 137. More particularly, the cylindrical extension 180 is formed integrally with the second portion 173 and extends outwardly from the first end 174A of the second portion 173. Additionally, the first portion 157 is disposed about the bore 137. Preferably, the first portion 157 has excellent electrical insulating properties. Consequently, the first portion 157 electrically insulates the contacts preventing a short circuit condition. In the preferred embodiment, the rotatable portion 119 and the first portion 157 are formed of reinforced or molded plastic, or the like; and the threaded fastener 139 and second portion 173 are made of a suitable metallic material, such as steel, or the like.

As shown, the first portion 157 includes a cavity 159. The second portion 173 includes two cylindrical passages 161 adjacent the cavity 159. The passages 161 permit passage of lead wires 163 from the second set of contacts 147 to the electromechanical device 103. Additionally, an encapsulant may be injected via holes (not shown) to fill the cavity 159. Any commercially available sealant may be employed in a known manner.

The first portion 157 is molded to form a flange 165. The second portion 173 includes an extension 185. An O-ring 169 is located at the perimeter of the flange 165. The extension 185 is crimped down on the flange 165 securing the first portion 157 to the second portion 173. The O-ring 169 acts as a seal to prevent contaminates from entering the housing. Preferably, the O-rings 169 are formed of silicon rubber, or the like.

As would become evident to those skilled in the art, the first portion 157 may be secured to the second portion 173 by many other methods including, for example, bonding the first portion 157 to the second portion 173 with a type of cement. Any such method is not critical to the present invention and may be equally employed.

Figure 3:
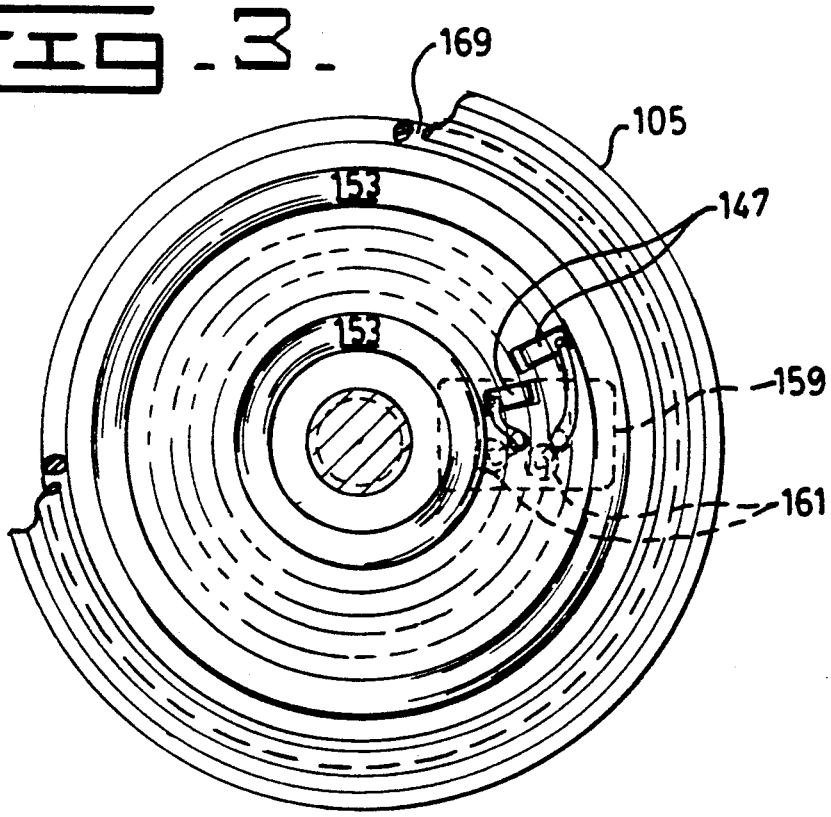
FIG. 3 is a top planar view similar to FIG. 2 illustrating a second embodiment of the present invention.

A second embodiment of the present invention is shown in FIG. 3. FIG. 3 is a top planar view of the housing 105. The housing 105 shown in FIG. 3 is similar to the one embodiment, and for simplicity, like elements are labeled the same. However, each contact of the second set 147 is not in the form of a ring. Rather, each contact is formed in a rectangular configuration. Additionally, each contact is made from a compliant electrically conductive alloy, for example. Preferably, the contacts are bent "out of the rectangular plane" such that the second set of contacts 147 are "spring" biased against the first set of contacts 145. Moreover, the second set of contacts 147 may assume various other shapes and forms which will become apparent to those skilled in the art without departing from the spirit of the present invention.

As shown, the second set of contacts 147 are spaced apart one from the other and radially disposed from the axis 111. Moreover, the housing 105 includes rectangular shaped recesses to accommodate the second set of contacts 147. The second set of contacts 147, as shown in FIG. 3, provide for a cost effective manufacturing of the electrical connector 100, since less conductive material is used.

The choice of disposing the "ring" contacts on the rotatable portion 119 and the "rectangular" contacts on the housing 105 is not critical to the present invention. For example, the "ring" contacts may be equally disposed on the housing 105 and the "rectangular" contacts on the rotatable portion 119 without departing from the present invention.

The exterior shape of the housing 105 is not critical to the present invention. Many profiles may be employed to facilitate use of a wide variety of commercially available wiring harnesses, as would become apparent to those skilled in the art. The exterior of the housing 105 should, however, have a hexagonal fitting 171 on the other end portion adjacent the first end 107 of the housing 105. The hexagonal fitting 171 enables the housing 105 to be screw threadably engaged into the bore 115 of the surface 113.

Industrial Applicability

As previously indicated, the electrical connector is to be rotatably mounted to a surface. The connector passes electrical signals to and from an electromechanical device 105. Some of the advantages of the present invention is best illustrated by an example, as described below.

Using the hexagonal fittings 171, the housing 105 is rotated and screw threadably mounted into a surface bore 115. The surface bore 115 may be located in an engine compartment, and more specifically, on an engine, for example. When the mounting is complete, the final angular orientation of the housing 105 is not determinable. However, because the rotatable portion 119 has an unlimited rotation about the axis 111, any manner of angular orientation about the axis 111 may be achieved in order to mate the receptacle 125 with a fitting.

As is well known, the external environment associated with an engine is harsh. Advantageously, the seal pair 153 along with the O-ring 169 act as a protective seal from corrosive agents such as diesel fuel and engine oil. Therefore, the contacts and the electromechanical device 103 are well shielded from the engine environment.

In summary, the present invention yields an electrical connector for passing electrical energy to and from an electromechanical device. Advantageously, the connector has an unlimited rotational orientation and is of a low-profile design. Moreover, the design of the connector protects the electromechanical device from harsh environmental hazards.

Other aspects, objects and advantages of the present invention can be obtained from a study of the drawings, the disclosure and the appended claims.

We claim:

1. An electrical connector for an electromechanical device, comprising:

a housing having first and second ends and an axis extending longitudinally through said housing, and being adapted to be connectable to a surface bore, said electromechanical device being disposable in said housing;

a rotatable portion having first and second ends and being rotatably connected to said housing, said second end of said rotatable portion being positioned adjacent to said first end of said housing along said axis;

means for fastening said rotatable portion to said housing, said rotatable portion being adapted to turn about said axis;

a first and second set of radially spaced, electrically conductive contacts being axially aligned with and radially disposed from said axis, said first set of contacts being disposed on said second end of said rotatable portion and said second set of contacts being disposed on said first end of said housing, wherein said first set of contacts is biased by said fastening means into slidable electrical contact with said second set of contacts to deliver electrical energy to said electromechanical device;

said first end of said housing defining a plurality of annular recesses being radially spaced from and coaxially disposed about said axis, said second set of contacts being disposed in said annular recesses;

a pair of circular bands of elastomeric material, each band having a circular cross sectional area and being disposed in said annular recesses; and wherein said second set of contacts are positioned between said pair of circular bands.

2. An apparatus, as set forth in claim 1, wherein said rotatable portion is adapted to turn at least 360° about said axis.

3. An apparatus, as set forth in claim 2, wherein each contact is formed in a ring coaxially disposed about said axis.

4. An apparatus, as set forth in claim 2, wherein each contact of the first set is shaped in the form of a ring and each contact of the second set is shaped rectangularly.

5. An apparatus, as set forth in claim 1, wherein said first end of said housing has a threaded bore, said bore being formed in said housing and disposed about said axis; and wherein said fastening means includes a threaded fastener adapted to be threadably engaged to said bore.

6. An apparatus, as set forth in claim 5, wherein said housing is an assembly including a first portion having first and second ends, said first end of said first portion being positioned adjacent said second end of said rotatable portion, said first portion having electrical insulating properties.

7. An apparatus, as set forth in claim 6, wherein said first portion is disposed about said bore.

8. An apparatus, as set forth in claim 7, wherein said housing includes a threaded end portion adjacent said second end, said second end of said housing being adapted to be screw threadably mountable in said surface bore.

* * * * *